US005426966A

United States Patent [19]

Krumholz

[11] Patent Number: 5,426,966

[45] Date of Patent: Jun. 27, 1995

[54] HYDRAULICALLY OPERATED PRESS BRAKE

[75] Inventor: Waldemar Krumholz, Hinwil, Switzerland

[73] Assignee: M & S Brugg Ag, Brugg, Switzerland

[21] Appl. No.: 135,720

[22] Filed: Oct. 13, 1993

[30] Foreign Application Priority Data

Oct. 26, 1992 [DE] Germany ..... 42 35 971.6

[51] Int. Cl.[6] ..... B21J 13/04; B21D 5/02

[52] U.S. Cl. ..... 72/389; 72/465; 72/482; 72/453.14; 188/371; 100/258 R

[58] Field of Search ..... 72/389, 465, 478, 482, 72/453.14; 188/371; 100/258 R, 258 A, 269 R

[56] References Cited

U.S. PATENT DOCUMENTS 3,550,425 12/1970 Cailoux ..... 72/453.14
5,067,340 11/1991 Mac Gregor ..... 72/389
5,272,904 12/1993 Krumholz ..... 72/389
5,293,972 3/1994 Krumholz ..... 72/389

FOREIGN PATENT DOCUMENTS 1308808 3/1973 United Kingdom ..... 72/453.14
548352 2/1977 U.S.S.R. ..... 72/453.14

*Primary Examiner*—David Jones
*Attorney, Agent, or Firm*—Tarolli Sundheim & Covell

[57] ABSTRACT

The press brake comprises a pressure ram member which is driven by two operating cylinders engaging the pressure ram member in the region of its two lateral ends. The pressure ram member has an upper and a lower portion which abut against each other in a central contact area and which are separated from each other by two gaps each running from the central contact area to the lateral ends, whereby the gap width continuously increases. Under load, the lower portion of the pressure ram member and the stationary ram member are deflected in the same sense. The degree of free deflection of the lower portion of the pressure ram member is limited by an adjustably mounted wedge member located in the gaps between the upper and lower portions of the pressure ram member. With this measure, the parallelism of the deflection lines is always maintained, even under extreme load situations.

9 Claims, 5 Drawing Sheets

HYDRAULICALLY OPERATED PRESS BRAKE

FIELD OF THE INVENTION

The present invention relates to a hydraulically operated press brake comprising a frame structure, a pressure ram member mounted in the frame structure to be vertically movable, a stationary ram member mounted in the frame structure, and at least two operating cylinders mounted in the frame structure and operatively connected to the pressure ram member in the region of the two lateral ends thereof for driving the pressure ram member to a motion against the stationary ram member and for retracting the pressure ram member vertically back from the stationary ram member.

Particularly, the invention relates to a press brake of the kind mentioned above in which the pressure ram member and the stationary ram member are mounted one above the other one, in which the pressure force is transmitted to the pressure ram member in the region of the two lateral ends thereof and in which the stationary ram member is freely supported in the region of its two lateral ends.

PRIOR ART

As is well known to any person skilled in the art, such press brakes show the disadvantage that the movable pressure ram member and the stationary ram member are deflected in opposite directions under load with the result that an uneven working gap between the movable pressure ram member and the stationary ram member is created. This disadvantage is particularly pronounced in big press brakes having a working area which is several meters in width and, in particular, if work pieces have to be bent the width of which being considerably smaller than the maximum working width.

Different measures have been proposed in the prior art which have as a goal to ensure an even working gap over the entire working width of the press brake by correcting the deflection line of at least one of the ram members and by compensating for the deviations of the deflection lines of the upper and lower ram member as far as the parallelism thereof is concerned, respectively. A common basic idea of most of these measures known in the prior art is to adapt the course of the deflection line of the upper ram member, i.e. the movable pressure ram member, to the course of the deflection line of the lower, i.e. the stationary ram member, by generating load-dependent counter forces in the upper pressure ram mender.

According to a solution well known in the art concerning press brakes of this kind, the lower portion of the upper movable pressure ram member is horizontally subdivided in several ram member elements which each cooperate with a separate operating cylinder and the pressing forces exerted by the individual ram member elements being controllable according to the load to which the assigned ram member element is subjected. Furthermore, the so called hydro cushion design usable for adapting the load distribution to the individual ram member elements have been used in the art for this purpose.

All these known solutions have the common disadvantage that the means for providing the required counter forces and the means for controlling the counter forces in dependence of the always changing load distribution conditions are extremely lavish, complicated and costly and, thereby, render the manufacture and the operation of such press brakes very expensive.

A much better solution has been disclosed in the German Published Patent Application P 41 38 286 (corres. to U.S. patent application Ser. No. 971,294, filed Nov. 4, 1992 by W. Krumholz). This press brake comprises a frame structure, a pressure ram member mounted in the frame structure to be vertically movable, and a stationary ram member mounted in the frame structure. The pressure ram member is divided into a first upper portion and a second lower portion along a plane essentially running perpendicular to the direction of motion of the pressure ram member.

Both the upper portion and the lower portion of the pressure ram member comprise a centrally located contact area where they abut against each other. The upper portion and the lower portion are separated from each other by two gaps running on each side from the contact area to the lateral ends of the pressure ram member portions with a continuously increasing width. The press brake further comprises at least two operating cylinders mounted in the frame structure and operatively connected to the upper portion of the pressure ram member in the region of the two lateral ends thereof for driving the pressure ram member to a motion against the stationary ram member and for retracting the pressure ram member vertically back from the stationary ram member.

In this way, it is ensured that the ram members are evenly deflected under load in the same sense at the edges facing the working area and located opposite to each other by providing that the flexibility of the ram portion facing the work piece to be bent is increased towards the lateral ends thereof such that the related ram mender portion inevitably takes a convex shape under load, in contrary to a one-part ram member which always will take a concave shape under the same conditions.

By a suitable selection of the course of the cross sectional area along the width of the ram member portions facing the working area, the section modulus of these portions can be adjusted such that the deflection lines of the two ram members essentially run parallel to each other under any load condition.

Experiences made with such a press brake have shown that the provision of a pressure ram member divided in two parts in connection with the selection of a suitable course of the cross sectional area of the two portions of the pressure ram member ensure a much higher degree of precision of the work pieces machined with such a press brake; furthermore, this is achieved in a less complicated and less expensive way as compared to other methods of compensating the deflection lines of the ram members.

According to a preferred embodiment of such a divided pressure ram member, the gaps running from the central contact area to the lateral ends of the pressure ram member extend along a straight line and are inclined downwards in a certain angle. Due to this inclination of the gaps, the cross sectional area of the lower portion of the divided pressure ram member diminishes from the center to the lateral ends, in accordance with the desired flexibility of the lateral end regions of the lower portion. The nominal width of the gap, i.e. the width measured under no-load condition at the lateral ends or the pressure ram member, is relatively small and amounts to approximately 1 mm, even in press brakes having a working area of a width of several meters and operating with forces up to 1000–2000 kN.

However, in these known press brakes having a divided pressure ram member, it is difficult to preselect the nominal width of the gaps such that, under load conditions, the parallelism of the deflection lines is ensured within close limits for all operating conditions occurring in everday's use and for the different parameters of the sheet metal material to be machined. Usually, in most practically occurring cases, the parallelism of the deflection lines is ensured within the set limits. But extreme operations, e.g. an uneven or asymmetric load of the pressure ram member during the machining of sheet metal pieces with a width much smaller than the maximum operation width of the press brake, or the processing of very thick sheet metal pieces, can result in a deviation of the course of the deflection lines from the desired parallel configuration. Thus, it is not possible to fulfill very high demands in precise processing and machining of work pieces with the press brakes known in the art as soon as one of these afore mentioned extreme operating situations occurs.

An important factor in this connection is the transition from an operating condition in which the gaps are still open, but the lower portion of the pressure ram member is freely deflected, to an operating condition in which the gaps are closed and the deflected lateral end regions of the lower portion abuts against the upper portion of the pressure ram member. This transition from one operating condition to the other one takes effect after the lower portion of the pressure ram member has been deflected by a certain degree under the influence of the pressure force exerted by the operating cylinders. Experience has shown that this transition can occur sometimes either to early or too late in the course of the pressing operation. In other words, the deflection of the lower portion of the pressure ram member can be too great in a first operating condition and too small in a second operating condition. Even more clearly said, the nominal width of the gaps can be either too great or to small under extreme operating conditions.

OBJECTS OF THE INVENTION

It is an object of the invention to provide a press brake of the kind referred to herein before which avoids the disadvantages of the known press brakes and ensures that the working gap always remains even along the entire operating width of the press brake.

It is a further object of the invention to provide a press brake of the kind referred to herein before which ensures that the inevitable deflection of the ram members under load is compensated for such that the deflection lines of the upper movable pressure ram member and the one of the lower stationary ram member run parallel to each other along the entire width of the press brake even under the worst, most extreme operating conditions, e.g. if the pressure ram member is asymmetrically loaded or if a very thick workpiece has to be processed.

It is a still further object of the invention to provide a press brake of the kind referred to herein before which provides for a working gap between upper movable pressure ram member and lower stationary ram member which has even width along the entire width of the press brake with simple and inexpensive means even under the worst, most extreme operating conditions, e.g. if the pressure ram member is asymmetrically loaded or if a very thick workpiece has to be processed.

SUMMARY OF THE INVENTION

To achieve these and other objects, the present invention provides, according to a first aspect, a hydraulically operated press brake comprising a frame structure, a pressure ram member mounted in the frame structure to be vertically movable, and a stationary ram member mounted in the frame structure.

The pressure ram member is divided into a first upper portion and a second lower portion along a plane essentially running perpendicular to the direction of motion of the pressure ram member. Both portions of the pressure ram member comprise a centrally located contact area where they abut against each other. The upper portion and the lower portion are separated from each other by a gap running on each side from the contact area to the lateral ends of the upper and lower portions of said pressure ram member with a continuously increasing gap width.

For driving the pressure ram member to a motion against the stationary ram member and for retracting the pressure ram member vertically back from the stationary ram member, at least two operating cylinders are mounted in the frame structure and operatively connected to the upper portion of the pressure ram member in the region of the two lateral ends thereof.

The lower portion of the pressure ram member is freely deflected upon operation of the operating cylinders to move the pressure ram mender against the stationary ram member and thereby exerting a pressure force on a workpiece inserted between the pressure ram member and the stationary ram member, whereby there are provided adjustable stop members for limiting the degree of free deflection of the lower portion of the pressure ram member.

According to a second aspect of the invention, in order to achieve essentially the same objects, the invention provides a hydraulically operated press brake comprising a frame structure, a pressure ram member mounted in the frame structure to be vertically movable, and a stationary ram member mounted in the frame structure. Further provided are at least two operating cylinders mounted in the frame structure and operatively connected to the upper portion of the pressure ram member in the region of the two lateral ends thereof for driving the pressure ram member to a motion against the stationary ram member and for retracting the pressure ram member vertically back from the stationary ram member.

The stationary ram member is divided into a first upper portion and a second lower portion along a plane essentially running perpendicular to the direction of motion of the pressure ram member, whereby both the upper portion and the lower portion of the stationary ram member comprise a centrally located contact area where they abut against each other. The upper portion and the lower portion are separated from each other by a gap running on each side from the contact area to the lateral ends of the upper and lower portions of the stationary ram member with a continuously increasing gap width. The lower portion of the stationary ram member is freely suspended in the frame structure in the region of the two lateral ends thereof.

The upper portion of the stationary ram member is freely deflected upon operation of the operating cylinders to move the pressure ram member against the stationary ram member and thereby exerts a pressure force on a workpiece inserted between the pressure ram member and the stationary ram member, whereby there are provided adjustable stop members for limiting the degree of free deflection of the upper portion of the stationary ram member.

Thereby, it is possible to adjust the occurrence of the above mentioned transition from free deflection to abutment independently from the load condition of the pressure ram member and stationary ram member, respectively, and, thereby, the operating conditions of the press brake can optimally match the most extreme situations without any loss in precision of machining or processing a work piece.

Since the width of the gaps between the upper and lower portions of the ram member is constructively fixed and cannot be varied without a great effort, there can be provided, on each side of the pressure ram member, a free space between the upper portion and the lower portion of the pressure ram member and located in the region of the lateral ends of the upper and lower portions, respectively. Each of the gaps open into one of the free spaces. Each of the free spaces are delimited, on its upper side, by an upper limiting surface constituted by a portion of the lower surface of the upper portion of the pressure ram member, and, on its lower side, by a lower limiting surface constituted by a portion of the upper surface of the lower portion of the pressure ram member.

Preferably, the upper and lower limiting surfaces extend in directions converging towards the center of the pressure ram member. The adjustable stop members for limiting the degree of free deflection of the lower portion of the pressure ram member preferably comprise a wedge member displaceably arranged in lateral direction within the free space between the upper and lower limiting surfaces.

A clearance may be provided between the upper surface of the wedge member and the upper limiting surface when the pressure ram member is in a no-load condition. The amount of the clearance can be variable by displacing the wedge member laterally along the free space, thereby limiting the degree of free deflection of the lower portion of the pressure ram member in function of the lateral position of the wedge member. With this simple measure, the degree of free deflection of one of the ram members can be limited to a preselectable amount which is less than the nominal width of the gaps.

The wedge angle needs to be only small, e.g. 5°. Thus, the wedge member is kept in its position in a self-locking manner under load so that no longitudinal forces occur which had to be supported by the displacement drive. On the other hand, a sufficiently long path of displacement results which renders the precise adjustment of the required clearance easy to accomplish.

In that phase of operation in which both portions of the ram member abut against other via the adjustable wedge member, the wedge angle of the limiting surfaces on the upper and lower ram portions which cooperate with the wedge member can slightly change. The reason is that the deflections of the two ram portions do not vary to the same degree when the load changes. In order to compensate for these angular variations, the wedge member preferably comprises an upper wedge portion and a lower wedge portion, the upper and lower wedge portions being located one above the other one and touching each other along a cylindrical face, whereby the axis of the related cylinder runs in a direction perpendicular to the path of motion of the pressure ram member and perpendicular to the path of displacement of the wedge member. In this way, the two wedge member portions may be tilted around the afore mentioned axis and displaced with regard to each other such that the wedge member always has a defined surface contact with the limiting surfaces of the ram member portions.

Preferably, the upper and lower wedge portions of the wedge member are elastically connected to each other, for example by a screw inserted into the lower wedge portion which penetrates the upper wedge portion with circumferential clearance, and an annular connecting member made of an elastically resilient material inserted into a bore provided in the upper wedge portion and being penetrated by the screw means. In this manner, the two wedge member portions are kept together in a no-load condition and, on the other hand, if they have been displaced with regard to each other under load, they are moved back into their original orientation as soon as the load has been removed.

BRIEF DESCRIPTION OF THE DRAWINGS

In the following, embodiments of the press brake according to the invention will be further described, with reference to the accompanying drawings, in which.

DETAILED DESCRIPTION OF THE PREFERRED EMBODIMENTS

Figure 1:
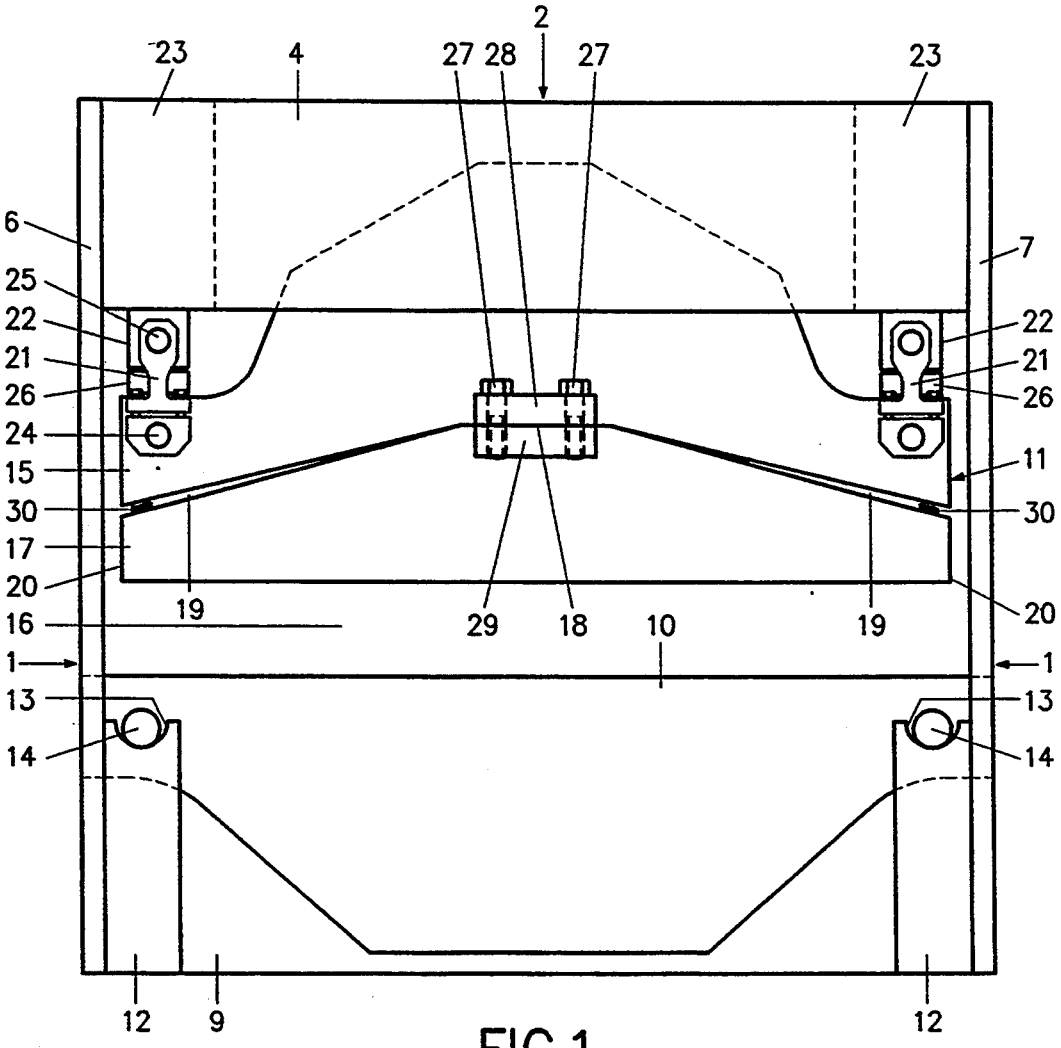
FIG. 1 shows a schematic front view of an embodiment of the press brake according to the invention in which there are schematically shown the means for limiting the degree of deflection of the lower portion of the pressure ram member.

As can be seen in FIG. 1, the press brake comprises a frame structure, essentially including two vertically extending lateral support members 1 and a cross beam 2 extending in horizontal direction and interconnecting the upper ends of the two vertical support members 1. The cross beam 2 has a box-like design and comprises two vertically extending longitudinal plate members 3 and 4, the two ends of them being interconnected by means of a vertically extending cross plate member 5. The lateral support members 1 each comprise two upright plate members 6 and 7 which are arranged in a certain distance from each other to leave a free space 8 between them. The plate members 6 and 7 are interconnected at their told by the cross beam 2 and at their bottom by means of a connecting member 9.

The active elements of the press brake are essentially constituted by a stationary ram member 10 and a vertically displaceable pressure ram member 11. Both the stationary ram member 11 and the pressure ram member 10 extend in horizontal direction between the two lateral support members 1 of the frame structure of the press brake into the free space 16 between the two plate members 6 and 7. Each carrier member 21 has an upper end which is pivotally connected to the piston rod 22 of the related operating cylinder 23, and a lower end which is pivotally connected to the protruding end portion of the pressure ram member 11. The pivot shaft connecting the lower end of the carrier member 21 to the pressure ram member 11 is designated with reference numeral 24, while the pivot shaft connecting the upper end of the carrier member 21 to the piston rod 22 of the operating cylinder 23 is designated with reference numeral 25.

In order to transmit the pressure exerted by the piston rods 22 of the operating cylinders 23 to the pressure ram member 11, there is provided a pressure transmitting joint in the form of a double articulation assembly 26. Details regarding the design and construction of the double articulation assembly 26 have not to be explained here.

The pressure ram member 11 is separated into two parts as seen in the direction of pressure induction. Particularly, the pressure ram member 11 comprises an upper portion 15 and a lower portion 17. Both the upper and lower portions 15 and 17, respectively, comprise a centrally located contact area 18 in which they rest on each other. On both sides of this contact area 18, gaps 19 are provided between the upper portion 15 and the lower portion 17. Both gaps 19 continuously increase in width from zero directly near the contact area 18 to a certain value at the lateral ends 20 of the pressure ram member 11. The particular design of the gaps 19, especially also the gap width, will be discussed later in more detail.

As already mentioned, the upper portion 15 of the pressure ram member 11 is suspended on the two piston rods 22 of the operating cylinders 23 by means of carrier members 21. The lower portion 17 of the pressure ram member 11 is suspended. In contrary to a solution known in the prior art, the limitation of the degree of deflection of the lower portion 17 of the pressure ram member 11 in the present invention does not take place by a direct engagement of the two opposite surfaces of the upper and lower portions 15 and 17, respectively, of the pressure ram member 11, but by the provision of the wedge members 30 inserted into the gaps 19 between the upper and lower portions 15 an 17, respectively, of the pressure ram member 11.

Figure 2:
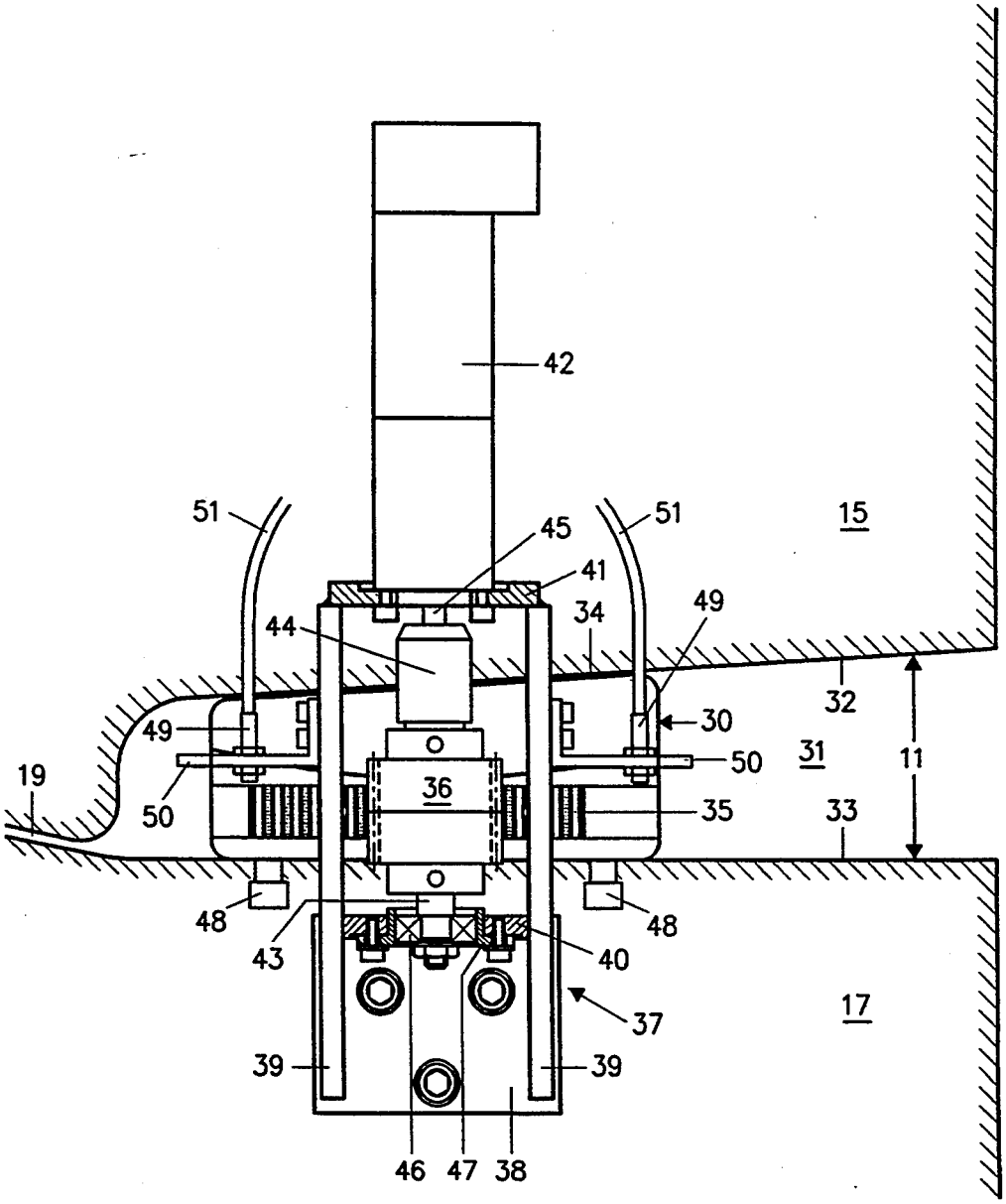
FIG. 2 shows a partial front view of the two part pressure ram member in the region of the end of the one side gap with the means for limiting the degree of deflection and the means for adjusting said means for limiting the degree of deflection in more detail.
Figure 3:
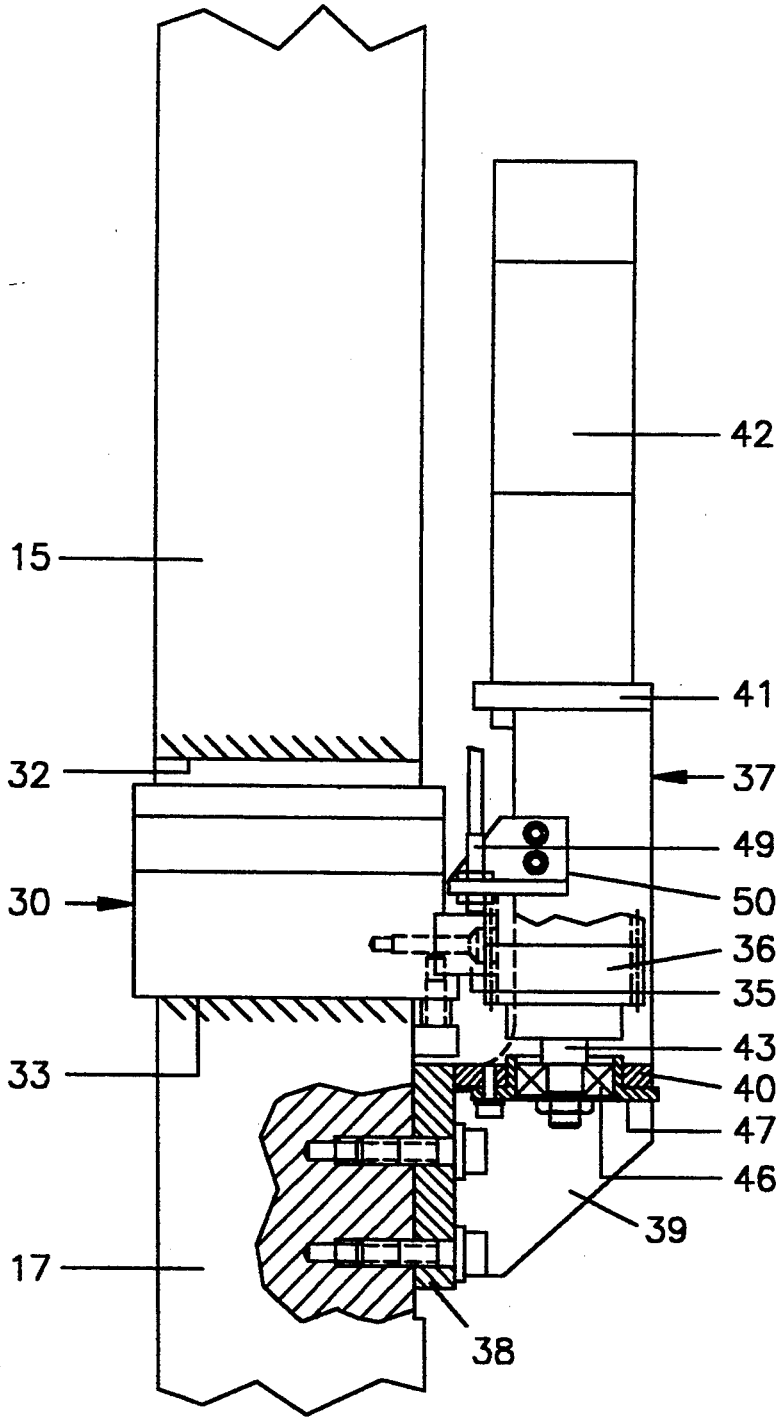
FIG. 3 shows a side view of the assembly according to FIG. 2.

In view of the fact that the nominal width of the gap 19 is very small, i.e. in the region of about 1 mm, an embodiment as schematically shown in FIG. 1 cannot be practically realized because a displaceable wedge member 30 and the means for its displacement could not be located within the very small gap 19. There, there is proposed an embodiment as shown in FIGS. 2 and 3 for the practical realization of the invention. It is understood that many other embodiments would be possible as is readily apparent to every person skilled in the art.

Figure 4:
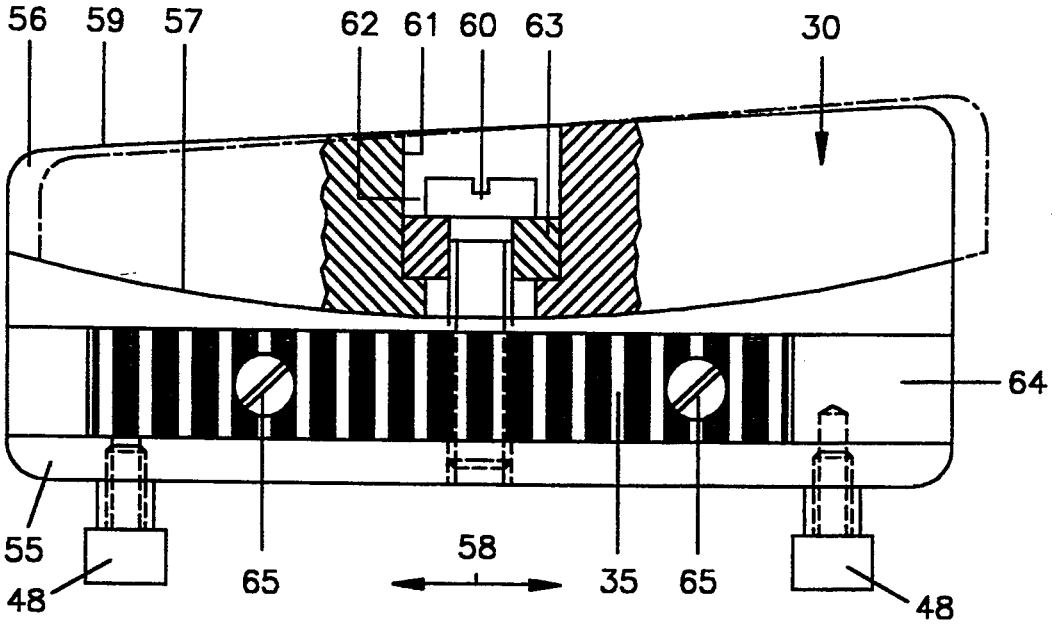
FIG. 4 shows a front view of a two part wedge assembly constituting an embodiment of the means for limiting the degree of deflection of the lower portion of the pressure ram member in a greater scale, partially sectioned.
Figure 5:
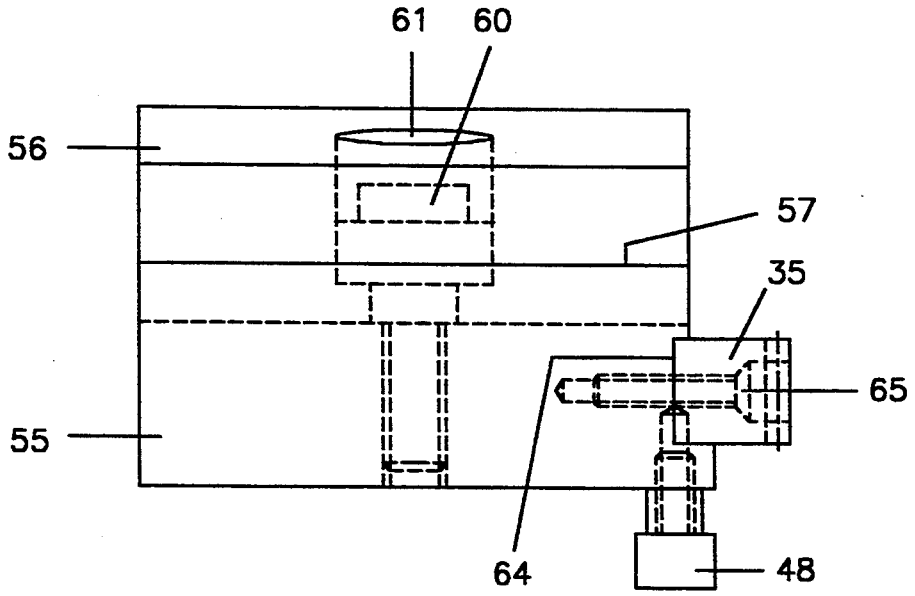
FIG. 5 shows a side view of the wedge assembly according to FIG. 4.

In FIGS. 2 and 3, there is shown a partial view of the upper and lower portions 15 and 17, respectively, of the pressure ram member 11 in the region of the one end thereof. The gap 19 provided between the upper and lower portions 15 and 17, respectively, opens into an end-sided wider space 31 provided by a recessed portion of the upper portion 15 of the pressure ram member 11. The limiting surfaces 32 and 33 which define this space 31 at the top and at the bottom extend in a wedge-shaped relationship with reference to each other, whereby the limiting surface 33 provided at the lower portion 17 of the pressure ram member 11 extends in horizontal direction, while the limiting surface 32 provided at the upper portion 15 of the pressure ram member 11 is inclined by an angle of e.g. 5°. In the space 31 between the two limiting surfaces 32 and 33, respectively, the wedge displaceable member 30 is located. This wedge member 30 rests on the lower limiting surface 33 whereby there is provided a certain clearance 34 between the upper surface of the wedge member and the limiting surface 32. Each of the probes 49 is connected to a supporting plate member 39 of the frame member 37 by means of an angled supporting member 50. In FIG. 4, such a displaced condition of the upper portion 56 with reference to the lower portion 55 of the wedge member 30 along the cylindrically shaped contact surface 57 is shown in dash-dotted lines. It is understood that the degree of relative displacement is greatly exaggerated for the sake of clarity. Finally, it can be seen in FIG. 4 that the rack member 35 is inserted into a longitudinal groove 64 provided at the lower portion 55 of the wedge member 30 and secured thereto by means of two screws 65.

Figure 6:
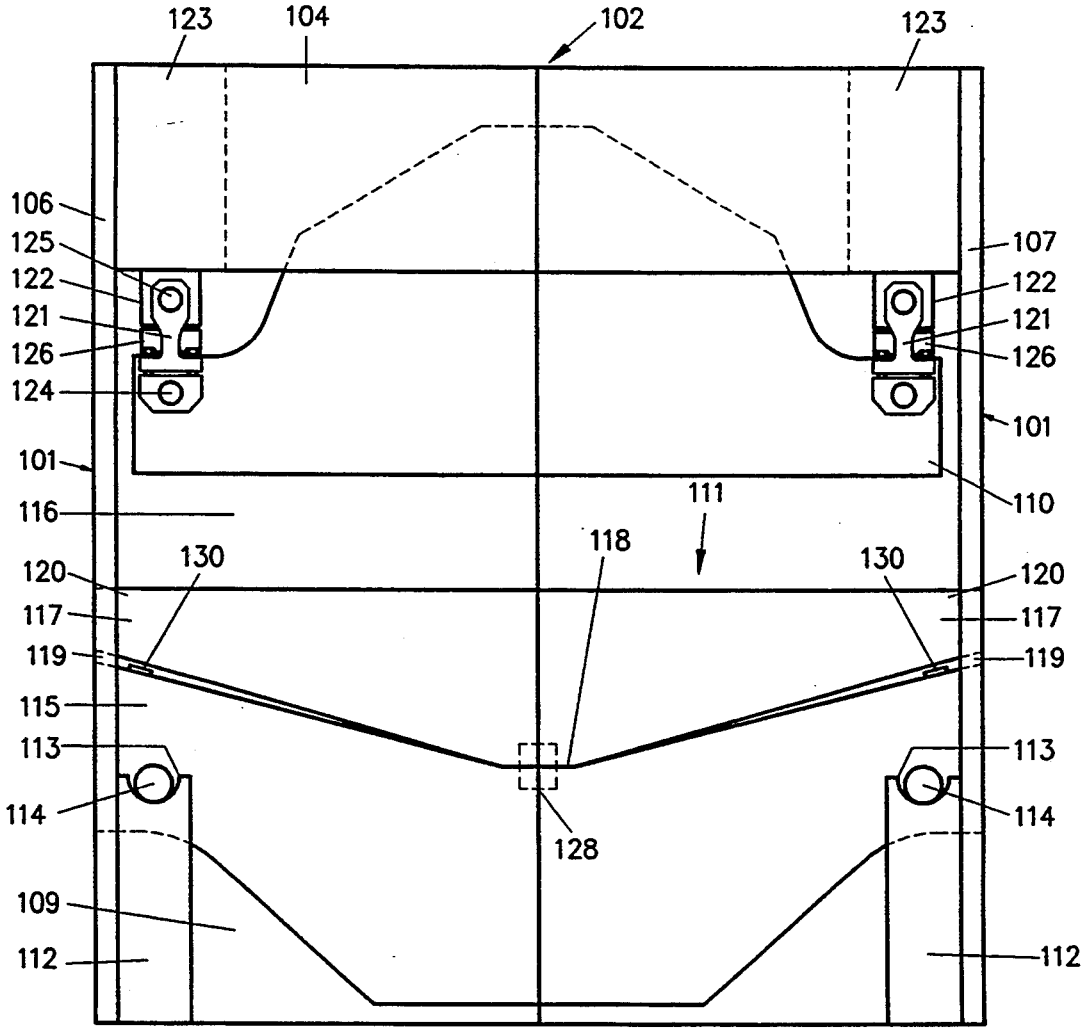
FIG. 6 shows a schematic front view of another embodiment of the press brake according to the invention in which there are schematically shown the means for limiting the degree of deflection of the upper portion of the stationary ram member.

In FIG. 6, there is shown a further embodiment of a press brake according to the invention. The press brake comprises a frame structure, essentially including two vertically extending lateral support members 101 and a cross beam 102 extending in horizontal direction and interconnecting the upper ends of the two vertical support members 101. The cross beam 102 has a box-like design and comprises two vertically extending longitudinal plate members 103 and 104, the two ends of them being interconnected by means of a vertically extending cross plate member 105. The lateral support members 101 each comprise two upright plate menders 106 and 107 which are arranged in a certain distance from each other to leave a free space 108 between them. The plate members 106 and 107 are interconnected at their top by the cross beam 102 and at their bottom by means of a connecting member 109.

The active elements of the press brake are essentially constituted by a stationary ram member 111 and a vertically displaceable pressure ram member 110. Both the stationary ram member 111 and the pressure ram member 110 extend in horizontal direction between the two lateral support members 101 of the frame structure of the press brake into the free space 116 between the two plate members 106 and 107. It is understood that the stationary ram member 111 and the pressure ram member 110 are equipped with bending tools which are not shown in the drawings.

The stationary ram member 111 is generally designed as freely supported cross member comprising an upper portion 117 and a lower portion 115. For this purpose, each one of the two connecting members 109 comprises two support members 112 mounted in a certain distance from each other on the corresponding connecting member 109 and being provided each with a bearing shell 113 having a concave cylindrical surface. The two lateral ends of the lower portion 115 of the stationary ram member 111 have lateral end portions protruding into the space between the support members 112; these lateral end portions are provided with a cylindrical gudgeon pin 114 having two protruding ends resting in the bearing shells 113 of the support members 112.

The frame structure of the press brake is provided with two hydraulic cylinders 123 each comprising a piston (not shown) and a piston rod 122 for operating the pressure ram member 110 to a motion towards and away from the stationary ram member 111. These operating cylinders 123 are located in the region of the two lateral ends of the frame structure of the press brake. The pressure ram member 110 has two laterally protruding end portions. The pressure ram member 110 is suspended on the two piston rods 122 of the operating cylinders 123 by means of two carrier members 121. Each carrier member 121 has an upper end which is pivotally connected to the piston rod 122 of the related operating cylinder 123, and a lower end which is pivotally connected to the protruding end portion of the pressure ram member 110. The pivot shaft connecting the lower end of the carrier member 121 to the pressure ram member 110 is designated with reference numeral 124, while the pivot shaft connecting the upper end of the carrier member 121 to the piston rod 122 of the operating cylinder 123 is designated with reference numeral 125.

In order to transmit the pressure exerted by the piston rods 122 of the operating cylinders 123 to the pressure ram member 110, there is provided a pressure transmitting joint in the form of a double articulation assembly 126. Details regarding the design and construction of the double articulation assembly 126 have not to be explained here.

The stationary ram member 111 is separated into two parts as seen in the direction of pressure induction. Particularly, the stationary ram member 111 comprises an upper portion 115 and a lower portion 117. Both the upper and lower portions 115 and 117, respectively, comprise a centrally located contact area 118 in which they rest on each other. On both sides of this contact area 118, gaps 119 are provided between the upper portion 115 and the lower portion 117. Both gaps 119 continuously increase in width from zero directly near the contact area 118 to a certain value at the lateral ends 120 of the stationary ram member 111. The particular design of the gaps 119, especially also the gap width, have already been discussed in more detail herein before and the same applies accordingly to the embodiment according to FIG. 6.

The upper and lower portions 115 and 117, respectively, of the stationary ram member 111 loosely rest on each other at the central contact area 118. The mutual position of the upper and lower portions 115 and 117, respectively, is additionally set by means of an alignment pin 128 which is received in recesses provided both in the upper and lower portions 115 and 117, respectively, in the central contact area 118.

Within the gaps 119, on each side of the lower portion 115 of the stationary ram member 111, there are provided means 130 for limiting the degree of deflection of the upper portion 117 of the stationary ram member 111. It is understood that the particular design of the upper and lower portions 117 and 115, respectively, and of the means 130 for limiting the deflection can be similar as shown in FIGS. 2 to 5 and discussed in detail in connection therewith.

Otherwise, the remarks and explanations given herein before also apply correspondingly to the embodiment of FIG. 6, particularly as far as the deflection and the gap width are concerned.

Finally, is should be mentioned that a design of a press brake is also possible which has a two-part pressure ram member, e.g. like the embodiment in FIG. 1 to 5, as well as a two-part stationary ram member, e.g. like the embodiment of FIG. 6.

What is claimed is:

1. A hydraulically operated press brake comprising:

a frame structure;

a pressure ram member mounted in said frame structure to be vertically movable;

a stationary ram member mounted in said frame structure;

said pressure ram member being divided into a first upper portion and a second lower portion along a plane essentially running perpendicular to the direction of motion of said pressure ram member;

both said upper portion and said lower portion of said pressure ram member comprising a centrally located contact area where they abut against each other, said upper portion and said lower portion being separated from each other by a gap running on each side from said contact area to the lateral ends of said upper and lower portions of said pressure ram member with a continuously increasing gap width;

at least two operating cylinders mounted in said frame structure and operatively connected to said upper portion of said pressure ram member in the region of the two lateral ends thereof for driving said pressure ram member to a motion against said stationary ram member and for retracting said pressure ram member vertically back from said stationary ram member;

said lower portion of said pressure ram member being freely deflected upon operation of said at least two operating cylinders to move said pressure ram member against said stationary ram member and thereby exerting a pressure force on a workpiece inserted between said pressure ram member and said stationary ram member; and adjustable means for limiting the degree of free deflection of said lower portion of said pressure ram member.

2. A press brake according to claim 1 wherein there is provided, on each side of said pressure ram member, a free space between said upper portion and said lower portion of said pressure ram member and located in the region of the lateral ends of said upper and lower portions, respectively, each of said gaps opening into one of said free spaces, each of said free spaces being delimited, on its upper side, by an upper limiting surface constituted by a portion of the lower surface of said upper portion of said pressure ram member, and, on its lower side, by a lower limiting surface constituted by a portion of the upper surface of said lower portion of said pressure ram member.

3. A press brake according to claim 1 wherein said upper and lower limiting surfaces extend in directions converging towards the center of said pressure ram member, said adjustable means for limiting the degree of free deflection of said lower portion of said pressure ram member comprising a wedge member displaceably arranged in lateral direction within said free space between said upper and lower limiting surfaces.

4. A press brake according to claim 3 wherein there is provided a clearance between the upper surface of said wedge member and said upper limiting surface when said pressure ram member is in a no-load condition, the amount of said clearance being variable by displacing said wedge member laterally along said free space, thereby limiting the degree of free deflection of said lower portion of said pressure ram member in function of the lateral position of said wedge member.

5. A press brake according to claim 2 wherein there is provided a linear drive means operatively coupled to said wedge member for displacing said wedge member in lateral direction along said free space, said linear drive means being controlled through at least one position detector means.

6. A press brake according to claim 2 wherein said wedge member comprises an upper wedge portion and a lower wedge portion, said upper and lower wedge portions being located one above the other one and touching each other along a cylindrical face, the axis of the related cylinder running in a direction perpendicular to the path of motion of said pressure ram member and perpendicular to the path of displacement of said wedge member.

7. A press brake according to claim 6 wherein means are provided for elastically connecting to each other said upper and lower wedge portions of said wedge member.

8. A press brake according to claim 7 wherein said means for elastically connecting comprise a screw means inserted into said lower wedge portion which penetrates said upper wedge portion with circumferential clearance, and an annular connecting member made of an elastically resilient material inserted into a bore provided in said upper wedge portion and being penetrated by said screw means.

9. A hydraulically operated press brake comprising:

a frame structure;

a pressure ram member mounted in said frame structure to be vertically movable;

a stationary ram member mounted in said frame structure;

at least two operating cylinders mounted in said frame structure and operatively connected to said upper portion of said pressure ram member in the region of the two lateral ends thereof for driving said pressure ram member to a motion against said stationary ram member and for retracting said pressure ram member vertically back from said stationary ram member;

said stationary ram member being divided into a first upper portion and a second lower portion along a plane essentially running perpendicular to the direction of motion of said pressure ram member;

both said upper portion and said lower portion of said stationary ram member comprising a centrally located contact area where they abut against each other, said upper portion and said lower portion being separated from each other by a gap running on each side from said contact area to the lateral ends of said upper and lower portions of said stationary ram member with a continuously increasing gap width, said lower portion of said stationary ram member being freely suspended in said frame structure in the region of the two lateral ends thereof;

said upper portion of said stationary ram member being freely deflected upon operation of said at least two operating cylinders to move said pressure ram member against said stationary ram member and thereby exerting a pressure force on a workpiece inserted between said pressure ram member and said stationary ram member; and adjustable means for limiting the degree of free deflection of said upper position of said stationary ram member.

* * * * *